US010713881B2

(12) United States Patent
Layton

(10) Patent No.: US 10,713,881 B2
(45) Date of Patent: Jul. 14, 2020

(54) GAMING SYSTEM AND A METHOD OF GAMING

(71) Applicant: Aristocrat Technologies Australia Pty Limited, North Ryde (AU)

(72) Inventor: Malcolm John Layton, Wooloowara (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 59 days.

(21) Appl. No.: 15/274,977

(22) Filed: Sep. 23, 2016

(65) Prior Publication Data

US 2017/0076537 A1 Mar. 16, 2017

Related U.S. Application Data

(63) Continuation of application No. 11/958,048, filed on Dec. 17, 2007, now abandoned.

(30) Foreign Application Priority Data

Jan. 9, 2007 (AU) ..... 2007900084

(51) Int. Cl.
*G07F 17/32* (2006.01)
*G07F 17/34* (2006.01)

(52) U.S. Cl.
CPC ..... *G07F 17/3213* (2013.01); *G07F 17/32* (2013.01); *G07F 17/3244* (2013.01); *G07F 17/34* (2013.01)

(58) Field of Classification Search
CPC ..... A63F 13/10; G07F 17/3265; G07F 17/34; G07F 17/3213
See application file for complete search history.

(56) References Cited

U.S. PATENT DOCUMENTS

| | | | |
|---|---|---|---|
| 6,089,977 | A | 7/2000 | Bennett |
| 6,354,939 | B1 | 3/2002 | Morita et al. |
| 6,485,367 | B1 | 11/2002 | Joshi |
| 6,855,054 | B2 | 2/2005 | White et al. |
| 2002/0037762 | A1 | 3/2002 | Wood et al. |

(Continued)

FOREIGN PATENT DOCUMENTS

| | | | |
|---|---|---|---|
| AU | 2007205813 | A1 | 3/2008 |
| GB | 2081952 | A | 2/1982 |

(Continued)

OTHER PUBLICATIONS

Examiner's first report, dated May 1, 2009, on patent application No. AU 2007237307 by Aristocrat Technologies Australia Pty Limited.

(Continued)

*Primary Examiner* — David L Lewis
*Assistant Examiner* — Robert E Mosser
(74) *Attorney, Agent, or Firm* — McAndrews, Held & Malloy, Ltd.

(57) ABSTRACT

A gaming system is disclosed which comprises a symbol selector arranged to select a plurality of symbols from a set of symbols for display at a plurality of display positions, a symbol position modifier operable by a player to modify the display position of at least one symbol, and an outcome generator arranged to determine a game outcome based on the displayed symbols after modification by a player of the display position of at least one symbol. A corresponding method is also disclosed.

17 Claims, 7 Drawing Sheets

(56) References Cited

U.S. PATENT DOCUMENTS

| | | | |
|---|---|---|---|
| 2006/0030387 | A1 | 2/2006 | Jackson |
| 2008/0045319 | A1 | 2/2008 | Saito |
| 2008/0234030 | A1 | 9/2008 | Layton |

FOREIGN PATENT DOCUMENTS

| | | | |
|---|---|---|---|
| WO | 2007130444 | A2 | 11/2007 |
| WO | 2007143704 | A2 | 12/2007 |

OTHER PUBLICATIONS

Examiner's report No. 2, dated Jun. 29, 2010, on patent application No. AU 2007237307 by Aristocrat Technologies Australia Pty Limited.

Examiner's first report, dated Nov. 1, 2011, on patent application No. AU 2011200417 by Aristocrat Technologies Australia Pty Limited.

Patent Examination Report No. 1, dated Dec. 17, 2012, on patent application No. AU 2012203429 by Aristocrat Technologies Australia Pty Limited.

| 304 | 306 | 308 | 310 | 312 |
|---|---|---|---|---|
| Queen | Queen | King | 10 | Jack |
| Ace | 9 | Ace | 9 | King |
| King | Jack | Jack | Queen | 10 |

Fig. 8A

| 304 | 306 | 308 | 310 | 312 |
|---|---|---|---|---|
| Queen | Queen | Queen | 10 | Jack |
| Ace | 9 | Ace | 9 | King |
| King | Jack | Jack | King | 10 |

Fig. 8B

| 304 | 306 | 308 | 310 | 312 |
|---|---|---|---|---|
| 9 | 10 | Jack | 10 | Moon |
| Queen | King | Ace | 9 | King |
| Ace | Queen | Star | Queen | Jack |

Fig. 8C

| 304 | 306 | 308 | 310 | 312 |
|---|---|---|---|---|
| Star | King | 9 | jack | Star |
| 9 | Moon | Ace | 9 | King |
| jack | Queen | Star | Queen | Jack |

Fig. 8D

| 304 | 306 | 308 | 310 | 312 |
|---|---|---|---|---|
| Star | King | 9 | jack | Moon |
| 9 | Star | Ace | 9 | King |
| jack | Queen | Star | Queen | Jack |

Fig. 8E

GAMING SYSTEM AND A METHOD OF GAMING

RELATED APPLICATIONS

This application claims priority to, and is a continuation of, co-pending U.S. application Ser. No. 11/958,048, filed on Dec. 17, 2007, which claims priority to Australian Patent Application No. 2007900084, filed on Jan. 9, 2007, all of which are incorporated herein by reference in their entirety.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

It is also known to provide a gaming system which operates such that a wild symbol progressively moves along a predetermined path with game outcomes being determined for each position along the path.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

a symbol selector arranged to select a plurality of symbols from a set of symbols for display at a plurality of display positions;

a symbol position modifier operable by a player to modify the display position of at least one symbol; and an outcome generator arranged to determine a game outcome based on the displayed symbols after modification by a player of the display position of at least one symbol.

In one arrangement, the gaming system comprises a display device.

The display device may be arranged to display graphical representations of a plurality of reels, each reel including a plurality of associated symbols.

In one arrangement, the symbol position modifier comprises a touch screen.

The set of symbols may include at least one function symbol having an associated function which may be a wild function, a scatter function, a multiplier function, a repeat win function or a jackpot function.

In a further alternative embodiment, the gaming system may be arranged to display a representation of a bingo card, the bingo card including the selected symbols.

In one embodiment, the gaming system is arranged to operate in normal game mode and special game mode, and the symbol position modifier is operable by a player to modify the display position of at least one symbol only when the gaming system operates in special game mode.

The gaming system may be arranged to commence special game mode when predetermined game outcomes occur, on the basis of a game event occurring during a game such as display of a particular symbol, based on game outcomes determined by the gaming system, in response to player input, based on the amount or type of bet placed, or when a special game is purchased by a player.

The gaming system may be arranged such that any one of the selected symbols is movable by a player, only one or more predefined symbol(s) is movable, or only one or more symbol(s) displayed in specific positions is movable.

The gaming system may be arranged so that a player is not compelled to move a symbol, and instead may choose to not move a symbol.

If a player does not make a decision as to movement of a symbol within a predetermined period of time, the gaming system may be arranged to assume that the player has chosen to not move a symbol. Alternatively, the gaming system may be arranged to automatically select and move a symbol to an optimal position in order to maximize a win outcome.

The gaming system may be arranged so as to allow movement of a symbol to any display position, or to allow movement of a symbol only to predetermined display positions, such as positions adjacent to the initial display position of the symbol.

In one embodiment, the gaming system is arranged to recommend to a player an optimum new display position for a symbol.

The gaming system may be arranged such that a symbol is moveable once per game, or more than once per game with a game outcome being determined after each symbol move. The number of symbol moves may be purchasable by a player.

In one embodiment, a symbol is moveable to a "sticky" position so that in subsequent games the symbol remains in the same display position whilst surrounding symbols are randomly selected and displayed.

When a symbol is removed from a display position, a randomly selected symbol may replace the moved symbol, a predetermined replacement symbol associated with the display position may be displayed, or the symbol to be moved and a symbol associated with the display position to which the symbol is to be moved may swap positions.

The gaming system may be arranged to display both a replacement symbol and a movable symbol at a display position.

Win outcomes may be determined and prizes awarded to a player as appropriate after a move has occurred, or both after selection and display of symbols and after a move has occurred.

As an alternative, win outcomes may be determined both after display of selected symbols and after a move has occurred and the highest prize awarded to the player.

The gaming system may be implemented as a stand alone gaming machine or across a network.

In accordance with a second aspect of the present invention, there is provided a method of gaming comprising:

selecting a plurality of symbols from a set of symbols for display at a corresponding plurality of display positions;

facilitate modification by a player of the display position of at least one symbol;

moving a symbol from a first display position to a second display position in response to input from a player; and determining a game outcome based on the displayed symbols after modification by a player of the display position of at least one symbol.

In accordance with a third aspect of the present invention, there is provided a computer program arranged when loaded into a computer to instruct the computer to operate in accordance with a gaming system comprising:

a symbol selector arranged to select a plurality of symbols from a set of symbols for display at a corresponding plurality of display positions;

a symbol position modifier operable by a player to modify the display position of at least one symbol; and an outcome generator arranged to determine a game outcome based on the displayed symbols after modification by a player of the display position of at least one symbol.

In accordance with a fourth aspect of the present invention, there is provided a computer readable medium having computer readable program code embodied therein for causing a computer to operate in accordance with a gaming system comprising:

a symbol selector arranged to select a plurality of symbols from a set of symbols for display at a corresponding plurality of display positions;

a symbol position modifier operable by a player to modify the display position of at least one symbol; and an outcome generator arranged to determine a game outcome based on the displayed symbols after modification by a player of the display position of at least one symbol.

In accordance with a fifth aspect of the present invention, there is provided a data signal having computer readable program code embodied therein for causing a computer to operate in accordance with a gaming system comprising:

a symbol selector arranged to select a plurality of symbols from a set of symbols for display at a corresponding plurality of display positions;

a symbol position modifier operable by a player to modify the display position of at least one symbol; and an outcome generator arranged to determine a game outcome based on the displayed symbols after modification by a player of the display position of at least one symbol.

BRIEF DESCRIPTION OF SEVERAL VIEWS OF THE DRAWINGS

Certain embodiments of the present invention will now be described, by way of example only, with reference to the accompanying drawings, in which:

FIGS. 8A to 8E are diagrammatic representations of example displayed symbols of a gaming system in accordance with an embodiment of the present invention during implementation of a game.

Figure 1:
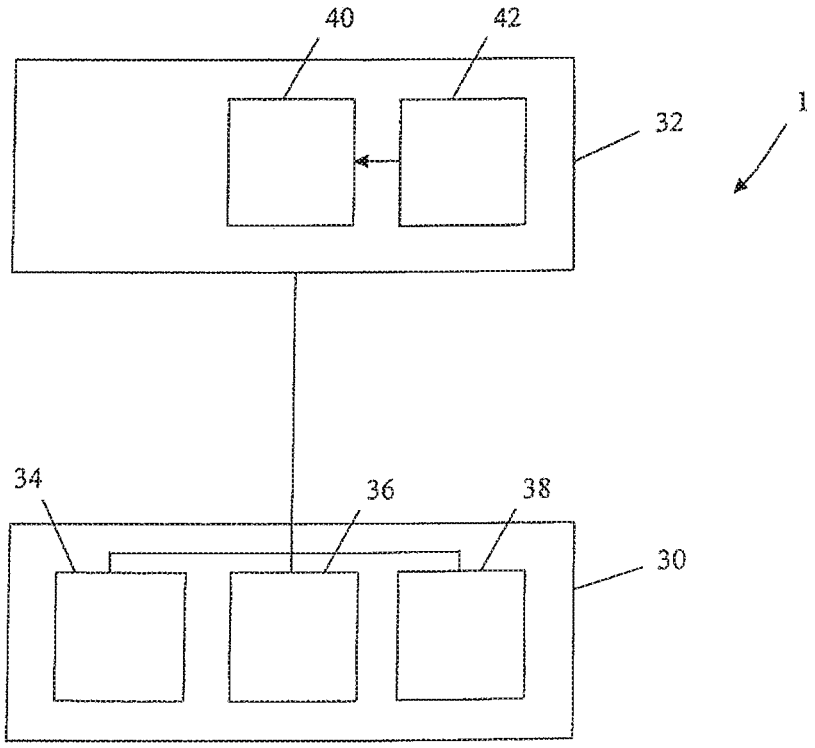
FIG. 1 is a schematic block diagram of core components of a gaming system in accordance with an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that at least during a portion of a game implemented by the gaming system a player is provided with the option to move at least one displayed symbol to a more favourable display position.

In this way, it is possible for a user to influence the game outcome and, in particular, to convert a non-winning game outcome to a winning game outcome or to convert a winning outcome to a more favourable winning outcome.

Referring to FIG. 1, a schematic diagram of core components of a gaming system is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
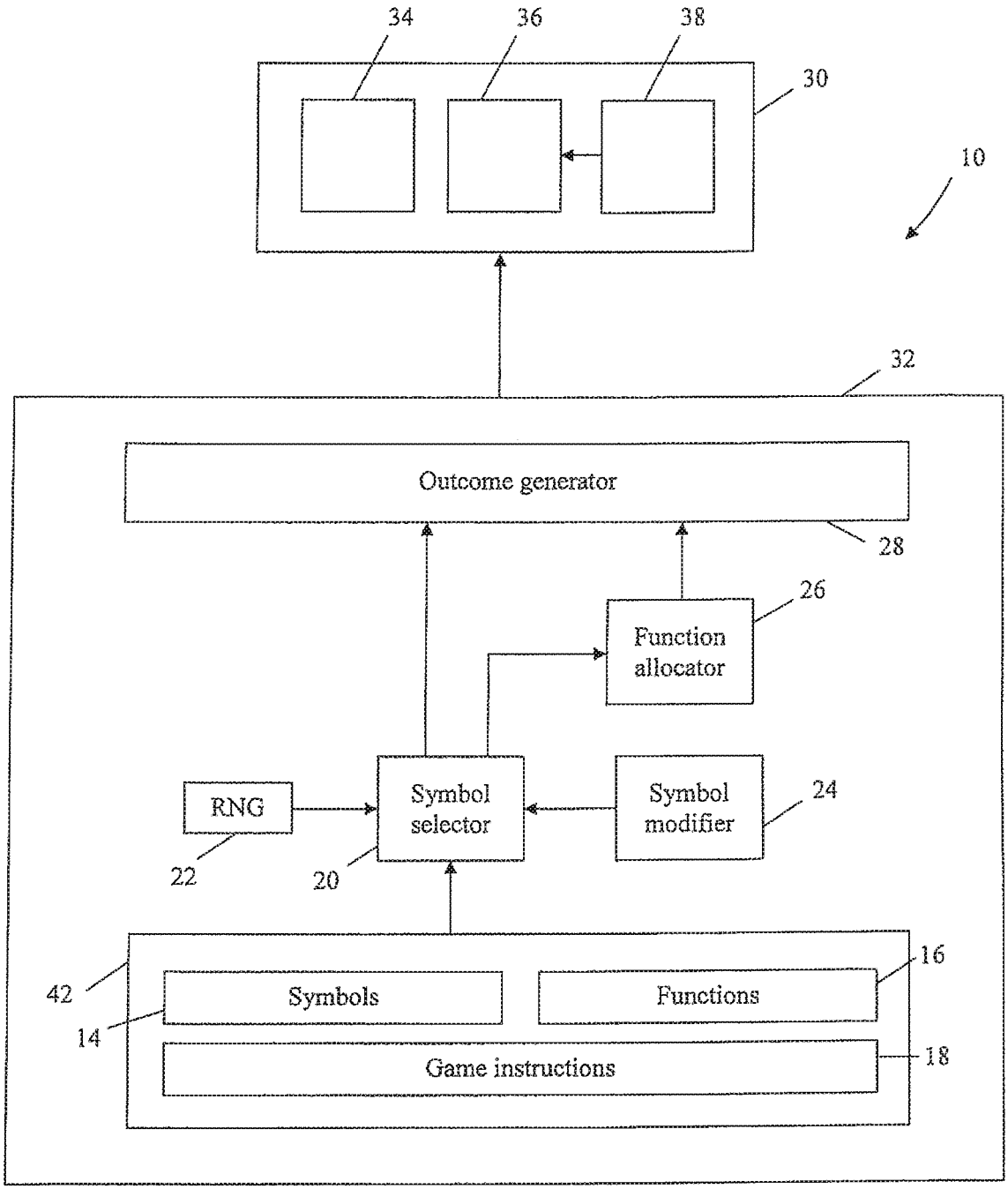
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

The game controller 32 includes a symbol selector 20 which is arranged to select several symbols from the selected symbols 14 for display to a player. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The game controller 32 also comprises a symbol position modifier 24 arranged, in this example in association with the display 36, to facilitate selection by a player of at least one displayed symbol, and selection by a player of a new display position to which the selected symbol is to be moved.

In this example, the game controller 32 also comprises a function allocator 26 arranged to select and allocate one or more functions to one or more symbols. Such functions include a wild function, a scatter function, or any other function which may be applied to a symbol or to the game.

The game controller 32 also comprises an outcome generator 28 which in accordance with the game instructions 18 determines game outcomes based on the symbols selected for display to a player by the symbol selector 20, and on the basis of display positions of the symbols after a symbol has been moved by a player.

In the embodiments described below, the symbol selector 20, the symbol modifier 24, the function allocator 26, and the outcome generator 28 are at least partly implemented using the processor 40 and associated software, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

A gaming system in the form of a stand alone gaming machine 44 is illustrated in FIG. 2. The gaming machine 44 includes a console 46 having a display 48 on which is displayed representations of a game 49 that can be played by a player. A mid-trim 50 of the gaming machine 44 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 46. A coin tray 60 is mounted beneath the front panel 59 for dispensing cash payouts from the gaming machine 44.

The display 48 is in the form of a video display unit, particularly a cathode ray tube screen device. Alternatively, the display 48 may be a liquid crystal display, plasma screen, or any other suitable video display unit. The top box 56 may also include a display, for example a video display unit, which may be of the same type as the display 48, or of a different type.

The display 48 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols, and if a function has been allocated to a reel, on the basis of the allocated function.

It will be understood that instead of providing a video display unit which displays representations of reels, physical reels may be used. Such gaming machines including actual rotatable reels are commonly termed stepper machines.

A stepper machine typically has a separate motor for each reel, and the game controller of such a gaming machine has a stop determining function that determines the stop position for each reel. For example, if there are five reels, each having twenty symbols, the stop determining function might determine that the stop positions are positions 3, 13, 7, 9 and 17. When a reel stops, the symbols will be in one of a plurality of possible symbol positions for that reel relative to the stop position.

Figure 3:
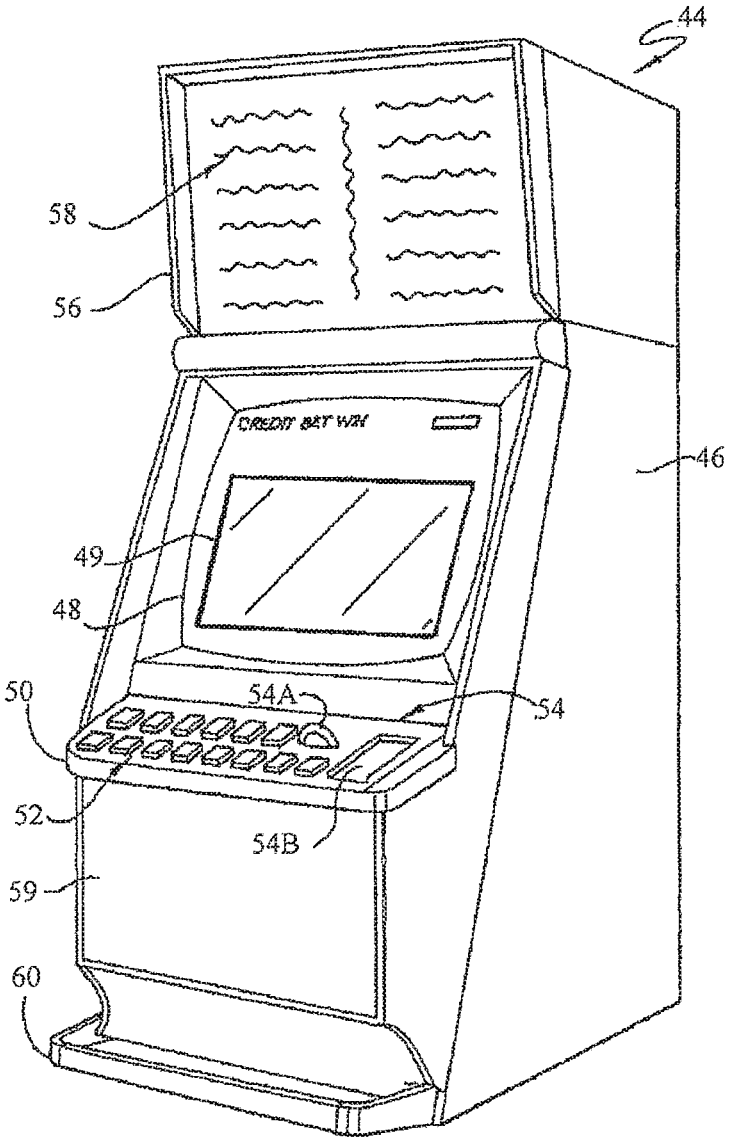
FIG. 3 is a diagrammatic representation of a gaming system in accordance with an embodiment of the present invention with the gaming system implemented in the form of a stand alone gaming machine.
Figure 4:
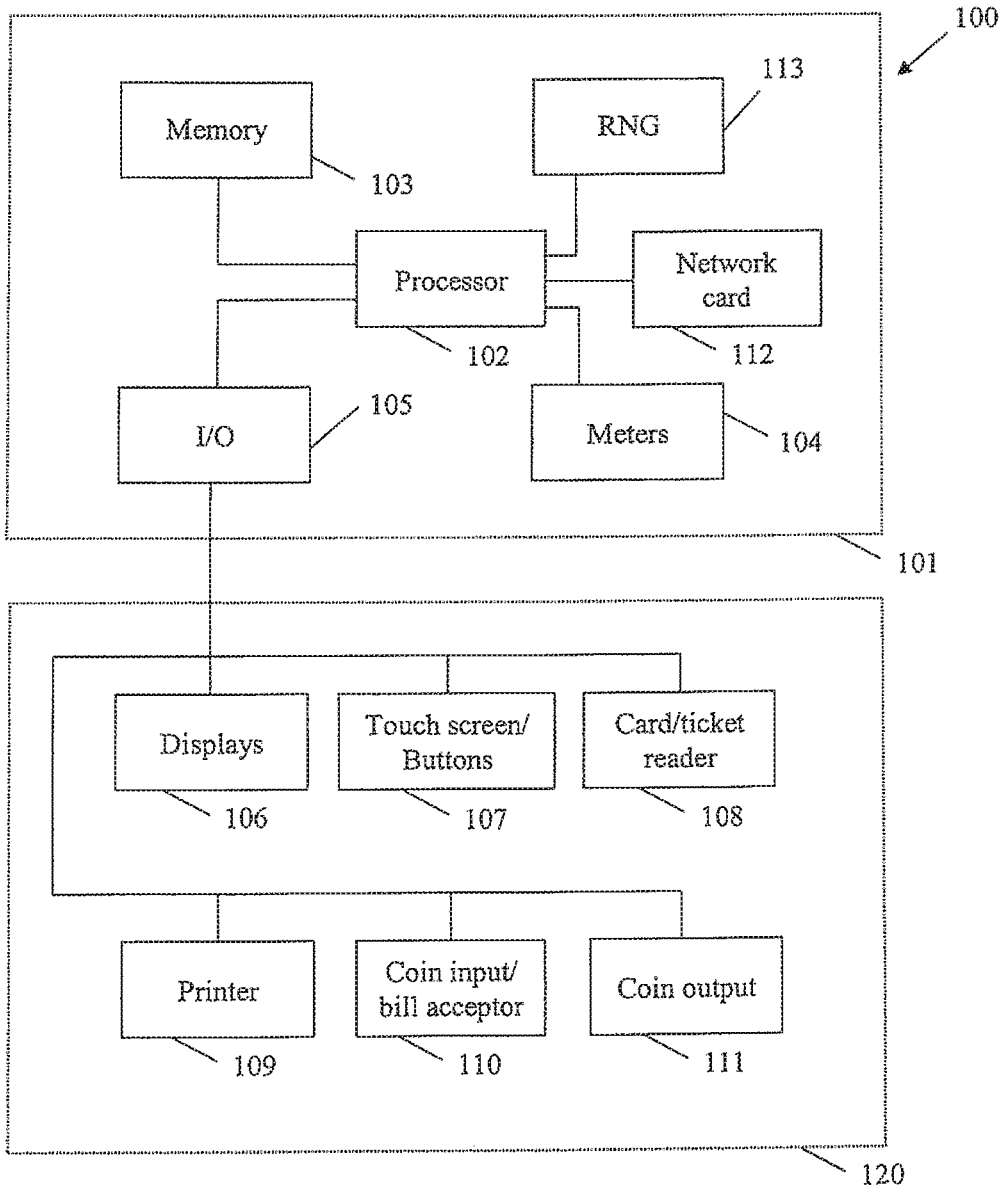
FIG. 4 is a schematic block diagram of operative components of the gaming machine shown in FIG. 3.

FIG. 4 shows a block diagram of operative components of a typical gaming machine 100 which may be the same as or different to the gaming machine shown in FIG. 3.

The gaming machine 100 includes a game controller 101 having a processor 102. Instructions and data to control operation of the processor 102 in accordance with certain embodiments of the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
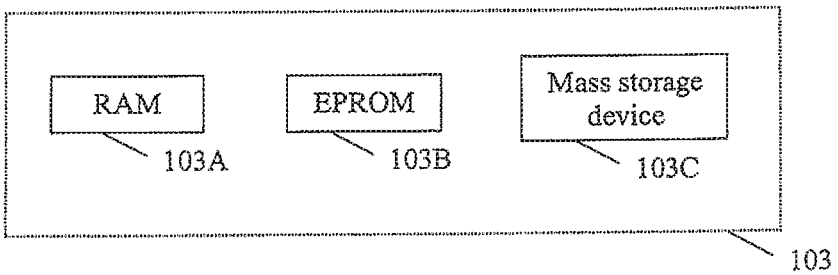
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
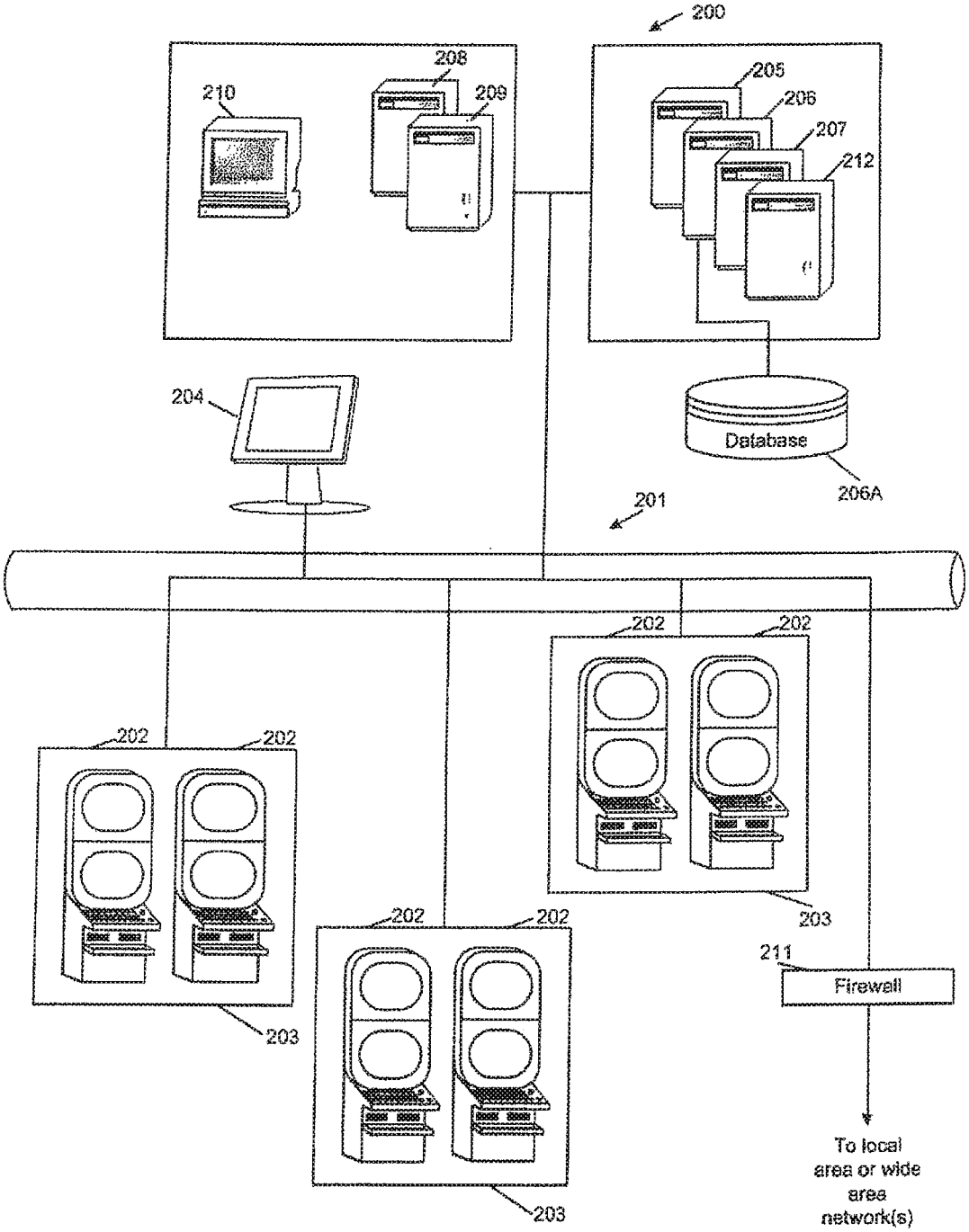
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 100 or over a network 201, implements a probabilistic game wherein at least during part of the game a player is able to move the display position of a symbol.

Examples of specific implementations of the gaming system will now be described in relation to a stand alone gaming machine 10, 44, 100 although it will be understood that implementation may also be carried out using other gaming system architectures such as a network architecture of the type shown in FIG. 6.

In one embodiment, the gaming system is operable in normal game mode and special game mode.

During normal game mode, reels comprising standard symbols and optionally one or more function symbols are provided. Win outcomes are determined on the basis of the symbols visible when the reels stop rotating, and in this example three symbols are displayed on each reel at any time. A win outcome may occur based on display of the same symbol along a horizontal or diagonal line, as scattered symbols, or in any other predefined way. A win outcome may also occur on the basis of one or more standard symbols in combination with at least one function symbol having a predetermined assigned function. For example a function symbol may correspond to a wild function, a scatter function, a multiply function, a repeat win function, and so on.

During special game mode, a player is provided with the opportunity to move a symbol prior to determination of a game outcome by the outcome generator 28.

The symbol which is movable by a player may be any displayed symbol, may be a specific symbol defined at commencement of the game or commencement of special game mode, or may be identified as a movable symbol when the symbol is displayed in a specific position.

The gaming system 10 may be arranged so that a player is not compelled to move a symbol, and instead may choose to not move a symbol. In the present specification, this is referred to as a "stand" option.

If a player does not make a decision as to movement of a symbol within a predetermined period of time, the gaming system may be arranged to assume that the player has chosen a stand option, or the gaming system 10 may be arranged to automatically select and move a symbol to an optimal position in order to maximize the win outcome.

The gaming system may be arranged so as to allow movement of a symbol to any display position, or to allow movement of a symbol only to predetermined display positions, such as positions adjacent to the initial display position of the symbol.

In one embodiment, the gaming system 10 is arranged to recommend to a user an optimum new display position for a symbol.

The gaming system may be arranged such that a symbol is moveable once per game, or more than once per game with a game outcome being determined by the outcome generator 28 after each symbol move. In embodiments wherein a symbol is moveable more than once per game, the gaming system 10 may be arranged so that the number of symbol moves is purchasable by a player.

In one embodiment, a symbol is moveable to a "sticky" position so that in subsequent games the symbol remains in the same display position whilst surrounding symbols are randomly selected and displayed. In this example, the original symbol moved to a "sticky" position may not be subsequently moved.

After movement of a symbol, in subsequent games during special game mode the symbol may remain at the new reel location, or the symbol may revert to the original reel location after each game.

When a symbol is removed from a display position, a randomly selected symbol may replace the moved symbol, a predetermined replacement symbol associated with the display position may be displayed, or the symbol to be moved and a symbol associated with the display position to which the symbol is to be moved may swap positions.

In the example wherein a predetermined symbol is displayed at a display position after movement of a symbol from the display position, the game controller 32 may be arranged to display both the predetermined symbol and the movable symbol at the same display position.

Win outcomes may be determined and prizes awarded to a player as appropriate after a move has occurred, or both after selection and display of symbols and after a move has occurred.

As an alternative, win outcomes may be determined both after display of selected symbols and after a move has occurred and the highest prize awarded to the player.

The gaming system may be arranged to commence special game mode when predetermined game outcomes occur and special game mode may comprise one or more free games, in this example three free games. Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10, 44, 100 may also be arranged so as to determine eligibility for special game mode, for example based on the amount or type of bet placed, based on certain time periods and so on.

Special game mode may also be arranged to commence when a special game is purchased by a player.

Figure 7:
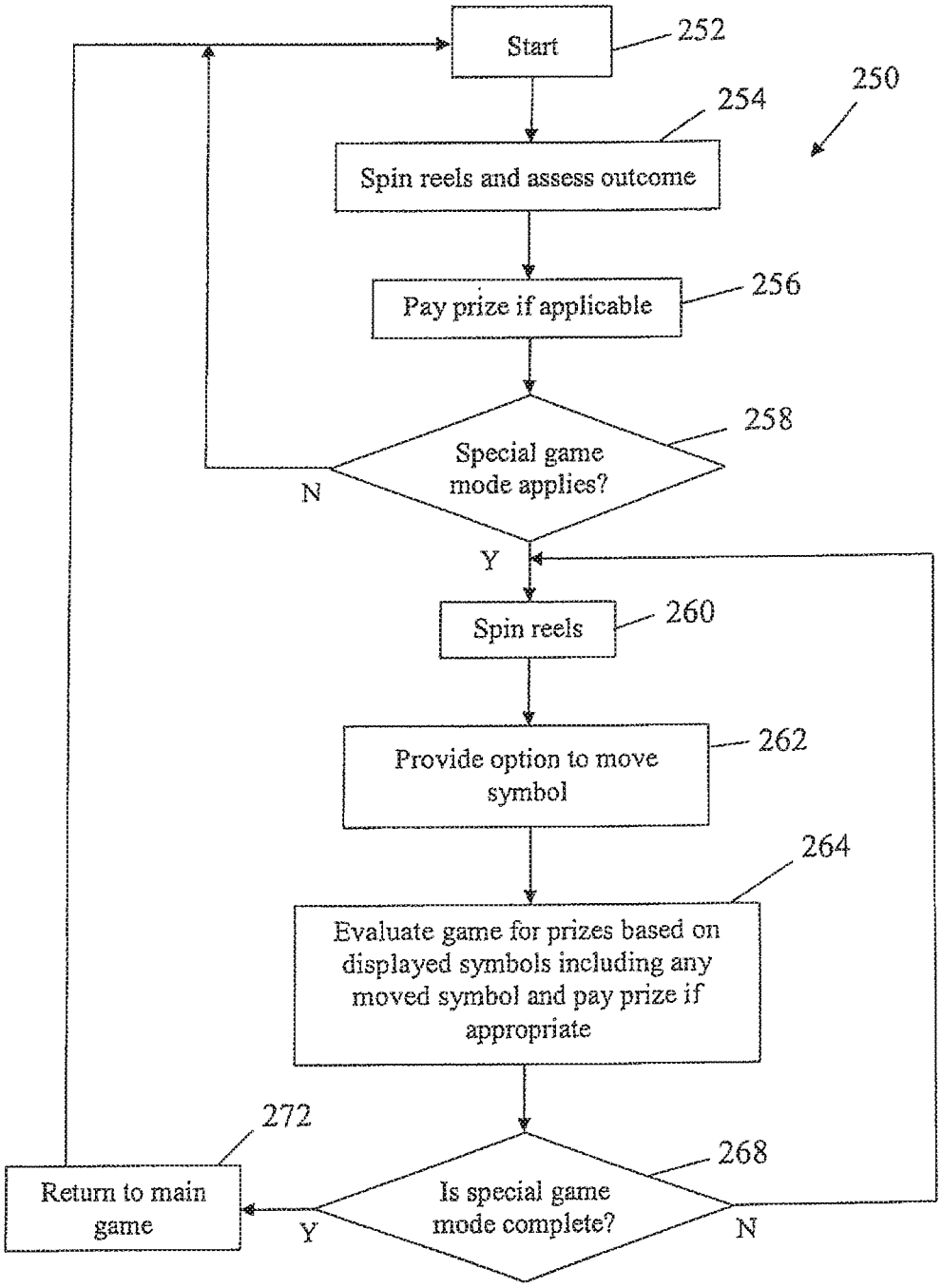
FIG. 7 is a flow diagram illustrating game play of a gaming system in accordance with an embodiment of the present invention.

A specific example will now be described in relation to flow diagram 250 shown in FIG. 7 which illustrates steps 252 to 272 of a method of gaming implemented by the gaming system according to the present embodiment.

In this example, five reels are provided, with each reel having multiple symbols. The reels are virtual reels and, as such, representations of the reels are displayed on a graphical display device 44. Example representations shown on the display device 44 are shown in FIGS. 8A to 8E.

The gaming system 10, 100 is operable in normal game mode and special game mode.

When a predetermined condition occurs during normal game mode, for example based on occurrence of a predetermined game outcome, by a player pressing a button after the player has identified that requirements for special game mode have been met, or in any other way, the gaming system 10, 44, 100 implements special game mode. Commencement of special game mode may be communicated to a player in any suitable way, for example by displaying an icon on the graphical display.

During special game mode, first, second, third, fourth and fifth reels 304, 306, 308, 310 and 312 rotate and the reels stop with three symbols displayed on each reel.

The player then has an option to move any one of the symbols in order to maximize the win outcome and thereby the prize awarded.

In this example, the display 48 is a touch screen display and the symbol modifier 24 therefore comprises components of the touch screen display which facilitate movement of a symbol by a player.

As shown in FIG. 8A, in the present example a player has selected a Queen symbol appearing on a third line of the fourth reel 310, and as shown in FIG. 8B the player chooses to move the selected symbol to a first line of the third reel 308.

Since the display now shows three Queens along a first line, a win outcome is determined on the basis of the three Queens and an appropriate prize provided to the player.

It will be understood that in the present example, the game controller 32 is arranged so as to swap symbols between an original display position and a new display position when a symbol is moved from the original position to the new position.

In the present example, special game mode comprises three games and, accordingly, the game controller 32 implements a second game by spinning the reels and stopping the reels at random locations as shown in FIG. 8C.

The player then has an option of moving one of the symbols. However, although in this example it is not possible for the player to improve the win outcome and, accordingly, the player chooses to "stand"; that is, the player chooses to not move a symbol.

In a third game, symbols shown in FIG. 8D are displayed. A player selects a star displayed in a first line of the fifth reel 312 and moves the star to a second line of the second reel 306. Since the symbols swap, a moon symbol originally appearing in the second line of the second reel 306 moves to the first line of the fifth reel 312.

The game outcome is then determined and a prize corresponding to three diagonally disposed stars is provided to the player.

Special game mode then ceases and the gaming system returns to normal game mode.

While the above examples are described in relation to a gaming system comprising physical or virtual spinning reels provided with symbols, it will be understood that the invention is applicable to other gaming systems wherein symbols are randomly displayed and the display positions of the symbols has an effect on the game outcome. For example, the invention may be applied to a gaming system arranged to implement a bingo style game.

Modifications and variations as would be apparent to a skilled addressee are deemed to be within the scope of the present invention.

The invention claimed is:

1. A gaming machine comprising:

a credit input operable to establish a credit balance;

a display device;

a player interface operable to receive one of a plurality of player selections; and a game controller comprising a hardware-implemented random number generator, a processor, and a memory storing a) a set of symbols for a plurality of reels, and b) instructions, which, when executed, cause the processor to at least:

generate a random outcome via the hardware-implemented random number generator, select a plurality of symbols from the set of symbols based on the random outcome;

control the display device to display the plurality of symbols selected at a plurality of display positions, receive via the player interface a first player selection of a first symbol located at a first display position and a second player selection of a second display position having a second symbol, wherein, if the first player selection and the second player selection are not received within a predefined period of time, the instructions, when executed, further cause the processor to select the first symbol located at the first display position and the second display position, to obtain an optimal selection in order to maximize a win outcome, control the display device to modify the second display position from displaying the second symbol alone to displaying both the first symbol and the second symbol, control the display device to modify the first display position from displaying the first symbol to displaying a predetermined replacement symbol associated with the first display position, and determine a game outcome based on the symbols displayed after modification of the second display position to have the first symbol, wherein, after the first symbol is displayed at the second display position, the instructions, when executed, further cause the processor to retain the first symbol in the second display position for at least one subsequent selection and display of symbols.

2. The gaming machine as claimed in claim 1, wherein the instructions, when executed, further cause the processor to allow movement of the first symbol to any display position.

3. The gaming machine as claimed in claim 1, wherein the instructions, when executed, further cause the processor to limit the second display position only to display positions adjacent to the first display position.

4. The gaming machine as claimed in claim 1, wherein the instructions, when executed, further cause the processor to recommend to a player the second display position.

5. The gaming machine as claimed in claim 1, wherein the instructions, when executed, further cause the processor to limit the first symbol to be only moveable once.

6. The gaming machine as claimed in claim 1, wherein the instructions, when executed, further cause the processor to operate in a normal game mode and a special game mode, and wherein the player interface is operable by a player to modify the second display position of the second symbol only in the special game mode.

7. The gaming machine as claimed in claim 1, wherein a total number of modifications of the display positions allowed for one or more of the plurality of symbols during play of a game is purchased by a player.

8. A method of gaming in a gaming machine having a credit input operable to establish a credit balance, a display device having a plurality of display positions, each display position being associated with a predetermined replacement symbol, a player interface operable to receive a plurality of player selections, and a game controller comprising a hardware-implemented random number generator, a processor, and a memory storing a set of symbols and instructions, which, when executed, cause the processor to initiate a game, the method comprising:

generating a random outcome via the hardware-implemented random number generator;

selecting based on the random outcome, via the game controller, a plurality of symbols from the set of symbols and controlling the display device to display the plurality of symbols selected at the plurality of display positions;

receiving via the player interface a first of the player selections of a first symbol located at a first display position and a second of the player selections of a second display position having a second symbol, and, in response to not receiving the first of the player selections and the second of the player selections within a predefined period of time, selecting the first symbol located at the first display position and the second display position to obtain an optimal selection in order to maximize a win outcome;

modifying via the game controller the second display position from displaying the second symbol alone to displaying both a) the first symbol and b) the second symbol;

receiving via the player interface a third of the player selections to modify the first display position from displaying the first symbol to displaying the predetermined replacement symbol associated with the first display position;

displaying the first symbol at the second display position;

determining a game outcome based on the symbols displayed after modification of the second display position to have the first symbol; and retaining the first symbol in the second display position after the first symbol is moved to the second display position for at least one subsequent selection and display of symbols.

9. The method as claimed in claim 8, wherein all of the symbols selected are available for movement by a player.

10. The method as claimed in claim 8, further comprising allowing movement of the first symbol to any display position.

11. The method as claimed in claim 8, further comprising limiting the second display position only to display positions adjacent to the first display position.

12. The method as claimed in claim 8, further comprising recommending to a player the second display position.

13. The method as claimed in claim 8, further comprising allowing the first symbol to be moved only once.

14. A gaming machine, comprising:

a display device;

a player interface operable to receive one of a plurality of player selections; and a game controller comprising a hardware-implemented random number generator, a processor and a memory storing a) a set of symbols for a plurality of reels, and b) instructions, which, when executed, cause the processor to at least:

generate a random outcome via the hardware-implemented random number generator, select a plurality of symbols from the set of symbols based on the random outcome;

cause the display device to display the plurality of symbols selected at a plurality of display positions on the display device, receive from the player interface a first selection of a first display position having a first symbol and a second selection of a second display position having a second symbol;

control the display device to modify the second display position from displaying the second symbol to displaying the first symbol, control the display device to modify the first display position from displaying the first symbol to displaying a replacement symbol, and control the display device to retain the first symbol in the second display position for at least one subsequent selection and display of symbols.

15. The gaming machine of claim 14, wherein execution of the instructions by the game controller, further cause the processor to determine a game outcome based on the symbols displayed following modification of the first display position and the second display position to have the replacement symbol and the first symbol, respectively.

16. The gaming machine of claim 14, wherein the instructions, when executed, further cause the processor to randomly select the replacement symbol based on a second random outcome generated by the random number generator.

17. The gaming machine of claim 14, wherein each display position is associated with a respective predetermined replacement symbol.

* * * * *